US005415565A

United States Patent [19]

Mosquera

[11] Patent Number: 5,415,565

[45] Date of Patent: May 16, 1995

[54] HOLDOWN KEY FOR LOW PROFILE CONNECTOR

[75] Inventor: Rene A. Mosquera, Laguna Niguel, Calif.

[73] Assignee: ITT Corporation, Secaucus, N.J.

[21] Appl. No.: 847,041

[22] PCT Filed: Mar. 13, 1992

[86] PCT No.: PCT/US92/02083

§ 371 Date: Apr. 15, 1992

§ 102(e) Date: Apr. 15, 1992

[87] PCT Pub. No.: WO93/18560

PCT Pub. Date: Sep. 16, 1993

[51] Int. Cl.[6] ..... H01R 13/73

[52] U.S. Cl. ..... 439/567; 439/571

[58] Field of Search ..... 439/567, 571–573, 439/82

[56] References Cited

U.S. PATENT DOCUMENTS

| | | | |
|---|---|---|---|
| 2,137,210 | 11/1938 | Lombard | 411/446 |
| 2,495,103 | 1/1950 | Huppert | 411/447 |
| 2,933,007 | 4/1960 | Healy | 411/57 |
| 3,907,392 | 9/1975 | Haag et al. | 439/218 |
| 3,975,076 | 8/1976 | Shida et al. | 439/62 |
| 4,274,700 | 6/1981 | Keglewitsch et al. | 439/682 |
| 4,583,807 | 4/1986 | Kaufman et al. | 439/83 |
| 4,639,066 | 1/1987 | Shimamiya et al. | 439/569 |
| 4,676,579 | 6/1987 | Ting | 439/82 |
| 4,710,852 | 12/1987 | Keen | 361/717 |
| 4,842,552 | 6/1989 | Frantz | 439/557 |
| 4,857,017 | 8/1989 | Erk | 439/695 |
| 4,907,987 | 3/1990 | Douty et al. | 439/571 |
| 4,943,244 | 7/1990 | Teck et al. | 439/567 |
| 5,135,412 | 8/1992 | Sitzler | 439/567 |
| 5,154,634 | 10/1992 | Brown et al. | 439/553 |
| 5,171,165 | 12/1992 | Hwang | 439/567 |
| 5,190,480 | 3/1993 | Chan et al. | 439/567 |
| 5,228,870 | 7/1993 | Gorenc et al. | 439/567 |

FOREIGN PATENT DOCUMENTS 802873 11/1956 United Kingdom .

*Primary Examiner*—Gary F. Paumen

*Attorney, Agent, or Firm*—Thomas L. Peterson

[57] ABSTRACT

A holdown key (40, FIG. 5) is provided that holds a low profile connector housing (30) to a circuit board (16), which securely holds the key to the connector before installation in the circuit board, and which provides high retention in the circuit board with only moderate stress on the key material. The key has a pair of largely vertically-extending legs (60, 62) with lower ends that merge and with upper ends that are free of each other but which have locations (80, 80*a*) that abut each other when the legs are deflected toward each other. When the key is installed in a slot (50) of the connector housing, the legs are preferably deflected partially towards each other so the gap (B) between the locations is less than initially, but is not zero. However, when the key is fully installed in the circuit board, the locations abut each other to close the gap (C) and provide large retention force in the circuit board. Each leg has upper and lower shoulders (100, 104) that abut upper and lower surfaces (102, 106) on the connector housing to retain the key in the housing.

10 Claims, 4 Drawing Sheets

FIG. 4
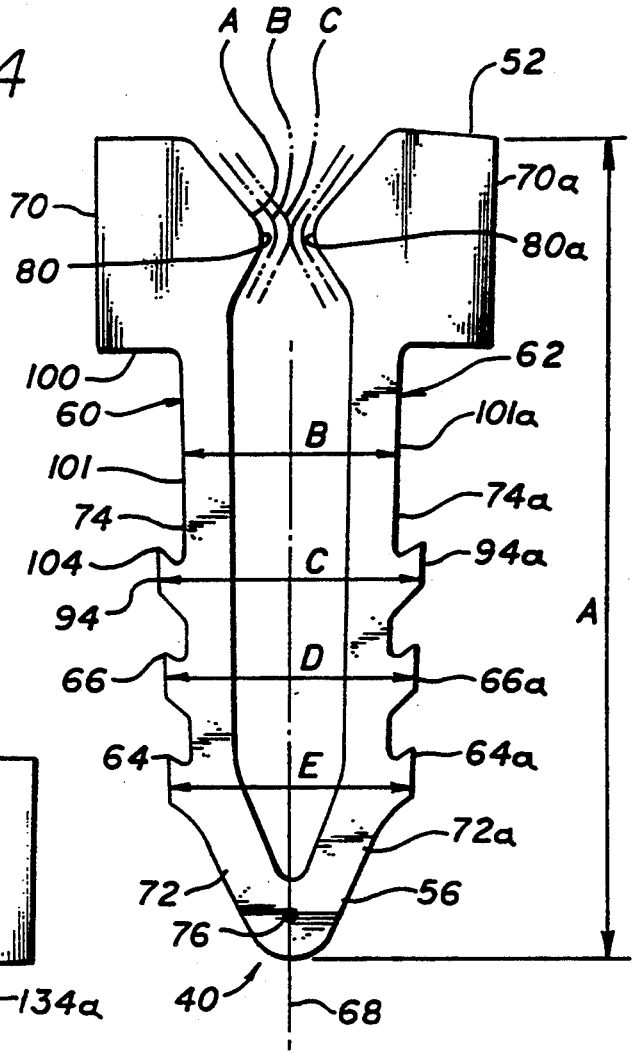
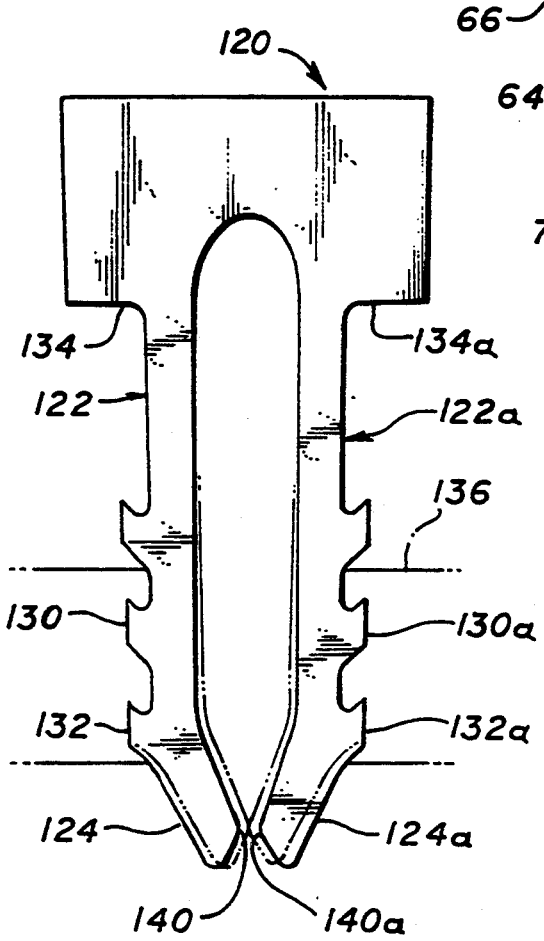
FIG. 6

HOLDOWN KEY FOR LOW PROFILE CONNECTOR

DESCRIPTION OF THE PRIOR ART

Electrical connectors that mount on the surface of a circuit board, can each include a connector housing that lies on the circuit board, multiple contacts with tails that press against corresponding pads on the surface of the circuit board, and a pair of keys at opposite ends of the connector housing that project through holes in the circuit board to retain the connector housing to the board. The keys may include a pair of largely vertical legs that are pressed down into the circuit board holes and that have barbs that dig into the walls of the holes. As the legs are pressed into the hole, the legs are resiliently deflected toward each other to provide a large holding force at the barbs. The keys hold the connector in place prior to soldering, and serve to relieve pressure on the solder joints that join the contact tails and circuit board pads when the connector is unmated from another connector and forces are applied that tend to pull the connector off of the board.

At present, a "standard" and widely used holdown key is formed of sheet metal and has a pair of legs whose upper ends merge and whose lower ends are free to deflect together. U.S. Pat. No. 5,080,611 describes keys of this type. Such legs can apply only a moderate resistance to deflection, and therefore can apply only a moderate retention force. Keys have been proposed wherein both the upper and lower ends of the legs merge, resulting in high resistance to bending of the beams toward each other. U.S. Pat. No. 4,907,987 describes keys of this type. Although merging the upper and lower ends of the keys makes the legs highly resistant to deflection toward each other, they can deflect only a moderate distance before plastic deformation begins. As a result, if there is poor matching of the key and circuit board hole, as where the hole is of maximum diameter and the distance between the key legs is minimum, this may result in only a very small or nonexistent retention force. Also, such keys can be difficult to stably mount in the connector so they remain stably in position prior to installation on a circuit board. A connector with holdown keys which could apply large retention forces in the most common cases, but which still applied moderate holdown force under "worst" case conditions, and which facilitated retention on the connector prior to mounting of the connector on a circuit board, would be of considerable value.

SUMMARY OF THE INVENTION

In accordance with one embodiment of the present invention, an electrical connector is provided which has a pair of keys for insertion in holes of a circuit board, wherein each key can provide high retention force in the circuit board under normal conditions, which reduces the possibility of plastic deformation under conditions of high interference fit, and which provides moderate retention force under conditions of low interference fit, and wherein the key is easily securely installed in the housing of the connector. Each key lies in a slot at the end of the connector housing and has a pair of largely vertically extending legs, with the legs extending below the bottom of the connector to enter a circuit board hole which deflects the legs toward each other. First ends of the legs merge and the opposite ends of the leg are free of each other but have locations that abut each other when the legs are deflected toward each other. The abutting locations are close enough that the legs can be deflected together until the locations abut each other, without substantial plastic deformation of any portion of the key. The presence of free ends allows the legs to be resiliently deflected by a large amount, which can assure at least moderate retention force in a large board hole and which can aid in retention of the key in the connector housing before the connector is installed on the circuit board. The fact that the free ends abut each other when the key is fully installed in the circuit board, results in large resistance to further deflection of the legs toward each other, to provide for high retention force under most circumstances.

The upper end portions of the legs can form upper projections while the middles of the legs can form lower projections. The projections form shoulders that abut upper and lower key-support surfaces on the connector housing to fix the position of the key on the connector housing prior to installation of the connector on the circuit board. The key is preferably formed with the upper ends of the legs being free and the lower ends of the legs merging, with barbs that engage the walls of the circuit board hole lying closer to the lower ends of the legs than to the upper ends thereof.

The novel features of the invention are set forth with particularity in the appended claims. The invention will be best understood from the following description when read in conjunction with the accompanying drawings.

BRIEF DESCRIPTION OF THE DRAWINGS

FIG. 4 is a side view of the holdown key of the connector of FIG. 3, shown in its initial, undeflected configuration.

FIG. 6 is a side elevation view of a holdown key constructed in accordance with another embodiment of the invention.

DESCRIPTION OF THE PREFERRED EMBODIMENTS

Figure 1:
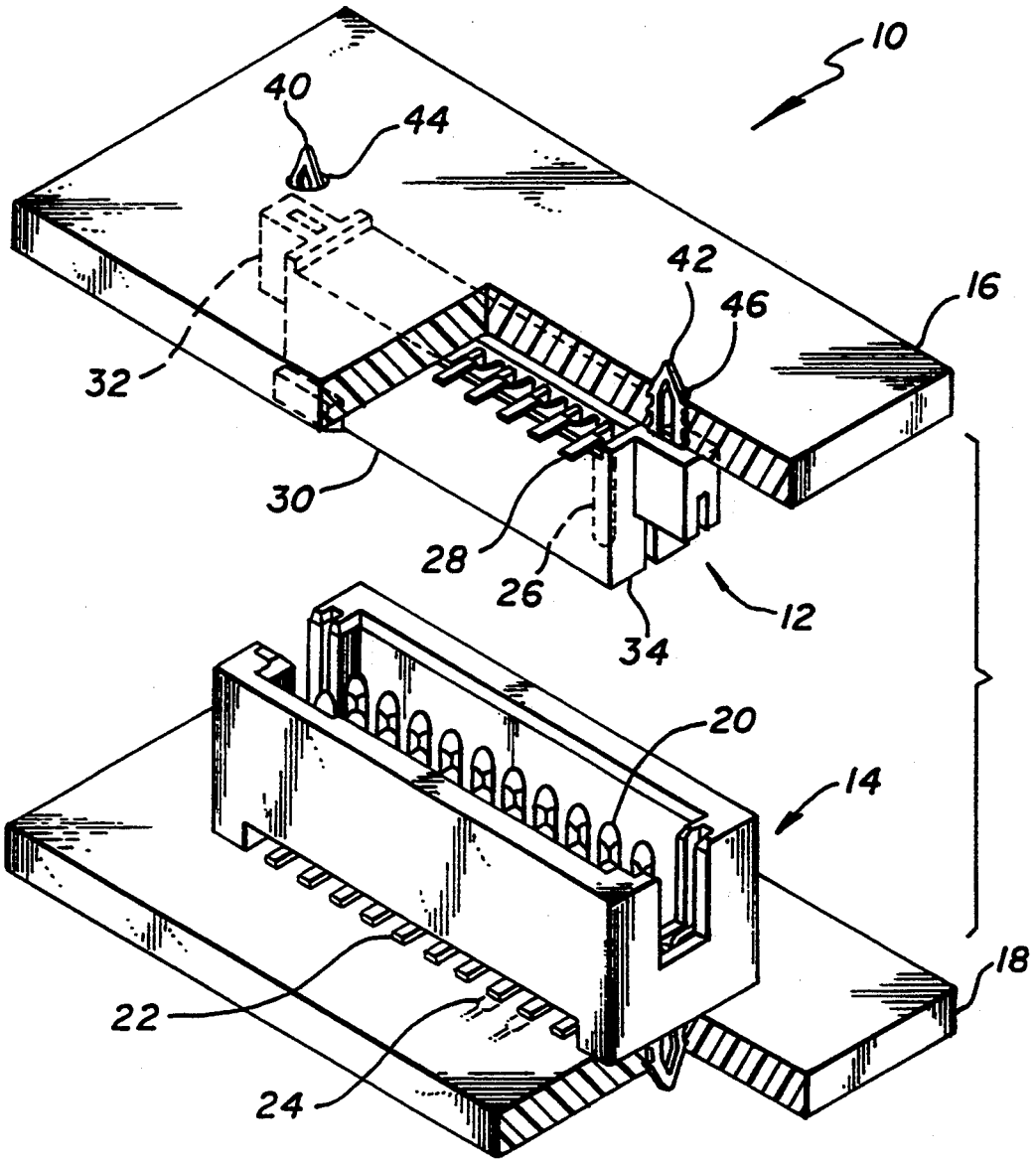
FIG. 1 is a partially sectional isometric view of a connector system which includes a pair of connectors that are each mounted on a corresponding circuit board, with the connectors lying close to a position where they would begin to mate.

FIG. 1 illustrates a connector system 10 which includes a pair of connectors 12, 14 that can mate, with each connector mounted on a corresponding circuit board 16, 18. The connector 14 has multiple pin contacts 20 that each has a tail 22 that presses against a conductive pad 24 on the circuit board 18 when the connector lies on the circuit board. Similarly, the connector 12 has a plurality of socket contacts 26 with tails 28 that engage conductive pads on the circuit board 16. Each connector such as connector 12 includes an insulative connector housing 30 that holds multiple contacts, and which has opposite ends 32, 34 that are held to the corresponding circuit board 16 by a pair of keys 40, 42.

Each key projects through a corresponding hole 44, 46 formed in the circuit board 16. It may be noted that the diameters of the circuit board holes such as 44, 46 and their spacing, as well as the size and spacing of the pads on the surface of the circuit board, have been set by current standards, and a connector generally should be constructed so its parts can fit a circuit board constructed to those standards in order to gain wide acceptance in the industry.

Figure 2:
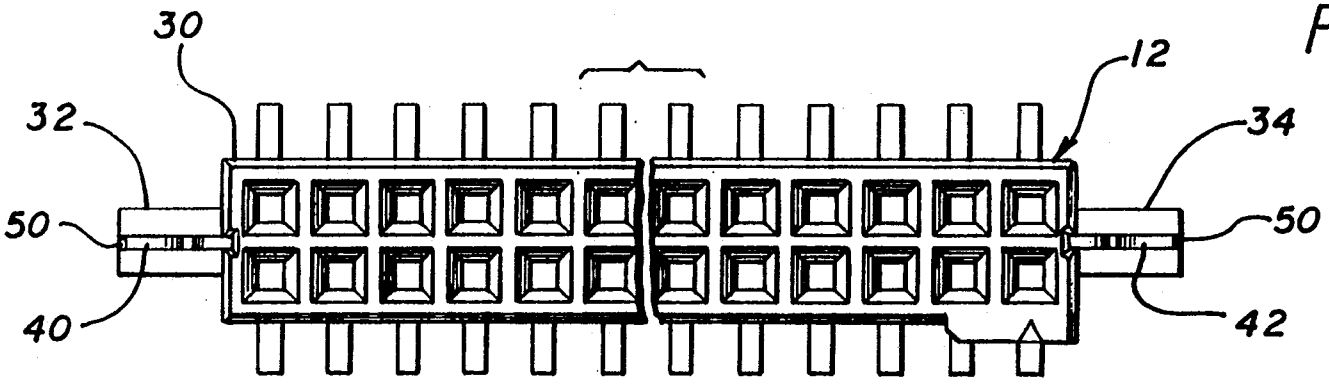
FIG. 2 is a plan view of a socket, or female connector of the system of FIG. 1.
Figure 3:
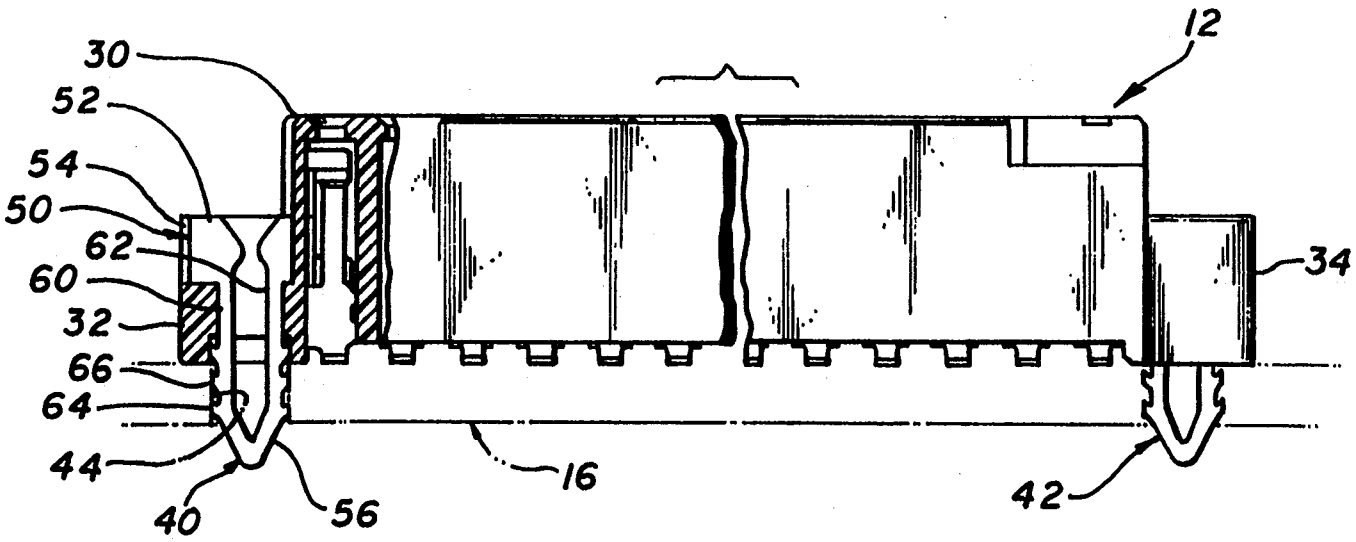
FIG. 3 is a partially sectional side view of the connector of FIG. 2.

FIGS. 2 and 3 illustrate some details of the socket or female connector 12. Each end 32, 34 of the connector housing 30 has a vertically-extending slot 50 which receives a key 40, 42. As shown in FIG. 3, the key has an upper portion 52 which lies in an upper portion 54 of the slot, and has a lower portion 56 which lies in and below a corresponding hole 44 in the circuit board 16. The key has a pair of legs 60, 62 which have barbs 64, 66 at their lower ends for "biting" into the walls of the circuit board hole 44 to retain the key, and therefore the entire connector 12, to the circuit board. The legs 60, 62 are deflected together when the lower portion 56 of the key is inserted into the circuit board, to firmly anchor the barbs 64, 66 in the circuit board. It can be seen from FIG. 2, that the particular key 50 is planar and is formed of a sheet of metal, so that it has a substantially uniform thickness, and can fit closely in the slot 50 of the connector housing.

FIG. 4 illustrates details of the key 40, showing it in its initial configuration, before it is installed on the connector housing. The key is symmetrical about a vertical axis 68, so the legs 60, 62 are mirror images of each other. Each leg has an upper end portion **70, 70*a*, a lower end portion 72, 72*a*, and a middle 74, 74*a*. The lower end portions 72, 72*a* merge at 76, and the arms cannot move or pivot relative to each other at the joined or merged location 76. The upper end portions 70, 70*a* of the arms are free of each other, so they can move towards and away from each other. Each upper end portion has a protuberance forming a convex abutting location 80, 80*a*. The abutting locations can abut each other when the upper end portions of the legs are deflected together. The legs are long and thin enough, and the abutting locations 80, 80*a* are close enough, that the locations can abut without plastic deformation of any portion of the key (relative to the shape of the key in its initial configuration of FIG. 4). When the convex locations 80, 80*a* abut each other, the upper end portions 70, 70*a* of the arms can still pivot relative to each other, as opposed to being fixed to each other as are the lower end portions. FIG. 4** shows the initial control gap at A, the partially closed gap at B which exists when the key is installed on the connector but not on the circuit board, and also shows the fully installed gap C which has zero width and which occurs when the key is fully installed in the circuit board.

Figure 5:
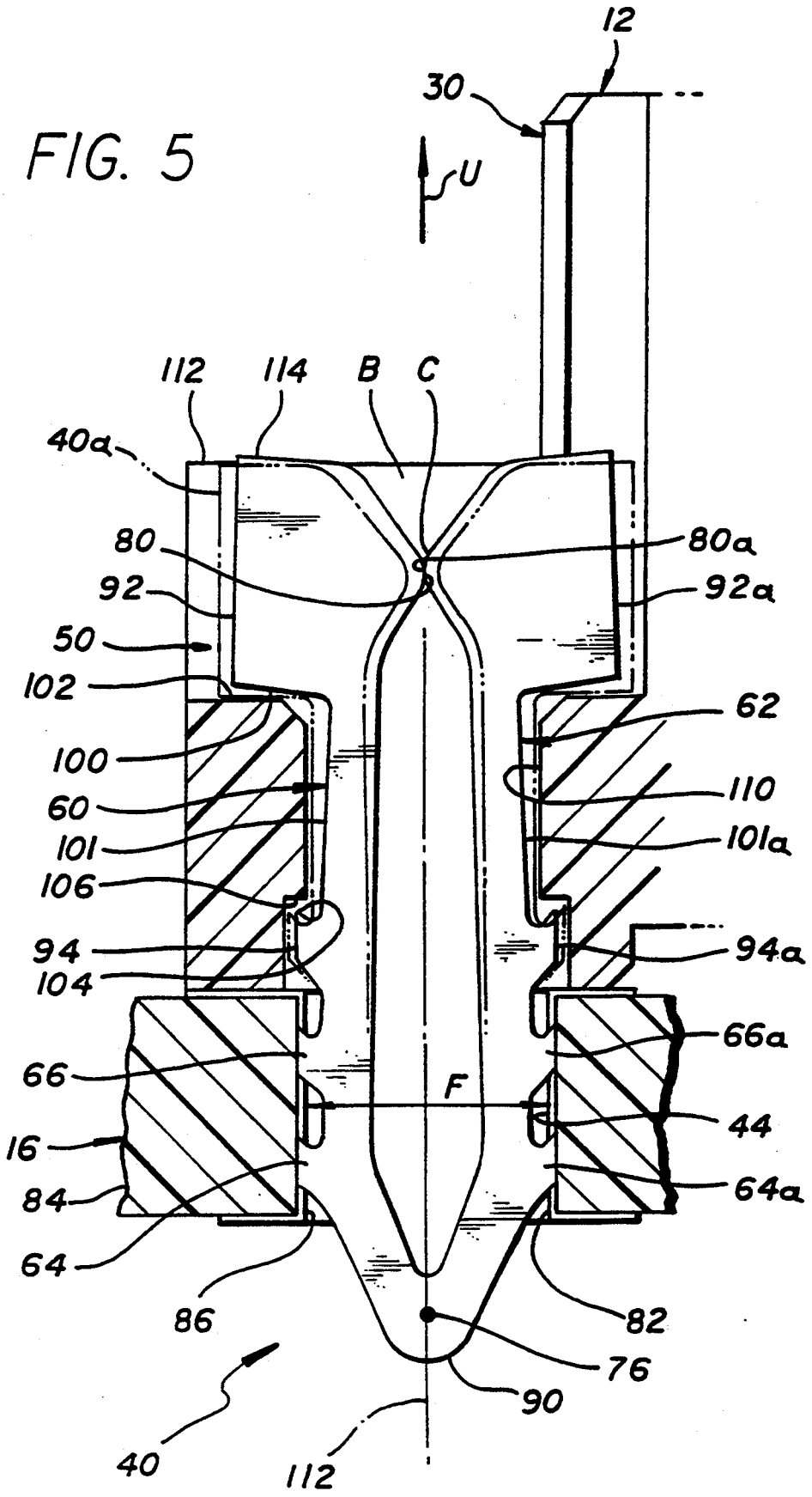
FIG. 5 is a side view of the key of FIG. 4, showing it installed on the connector housing and in the circuit board, so the key is in its fully installed and deflected position, the figure also showing, in phantom lines, the key in a partially deflected position.

FIG. 5 shows the key 40 after it has been installed on the connector housing 30, and after the connector housing with the key thereon has been installed on the circuit board 16, but prior to soldering of the circuit board. It can be seen that the gap C is fully closed, and the barbs **64, 64*a* and 66, 66*a* press firmly against the walls 82 of the circuit board hole 40. The circuit board includes a base 84, and may also include a layer 86 of conductive material on the walls of the hole (or may not include such layer). The arms have been deflected together sufficiently for the barbs to dig into the walls 82 of the hole to securely anchor the key in place. Usually, after such anchoring the assembly is soldered to solder the metal key to the plated walls of the hole. Whether soldered or not, the dug-in barbs securely anchor the connector housing in place to resist upperward forces in the direction U which occur when a mating connector is unmated from the connector 12**. Very secure anchoring of the barbs in the board holes is required even in the case of soldering, to avoid large forces on the solder which cannot be withstood by it.

The connector 12 can be initially assembled by installing the key 40 into the connector housing slot 50, with installation in the circuit board holes occurring later. It is highly desirable that the key be securely retained in the slot 50, and in a manner that closely fixes the orientation of the key in the slot, to assure that the tapered nose 90 at the bottom of the key will later accurately enter the circuit board hole. Each leg 60, 62 of the key includes upper projections **92, 92*a* and lower projections 94, 94*a* which serve to retain the key on the connector. When the key is installed in the connector slot, a downwardly-facing upper shoulder 100 on the upper projection 92 lies substantially against an upper key-supporting surface 102 on the connector housing. Also, at that time a lower shoulder 104 on the lower projection lies adjacent to a lower key-supporting surface 106 on the connector housing. The upper and lower shoulders 100, 104** prevent the key from moving substantially up and down relative to the connector housing.

When the key is installed, it lies in the position 40A shown in phantom lines in FIG. 5, with the arms 60, 62 having been deflected together so the gap has the partially closed width shown at B. This is caused by in the outer surfaces **101, 101*a* of the arms that lie between the shoulders 102, 104 bearing against the walls of a narrowed slot portion 110 which lies between the upper and lower surfaces 102, 106. The pressure of the legs against the narrow slot portion 110 results in the key being held stably in position and with the nose 90 lying substantially on the vertical axis 112** of the slot. Such firm holding of the key not only helps assure alignment of the key with the circuit board hole, but also prevents "rattling" of the key on the connector, which detracts from the appearance of quality of the connector as where the connector with the key installed therein is sold to a customer who will install it on a circuit board.

During installation of the key projections **94, 94*a* in the connector, the legs 60, 62 must be pressed tightly together until the abutting locations such as 80 abut each other and the control gap width C is zero. Also, the beams are bowed inwardly towards each other to allow the projections 94, 94*a* to pass through the narrow slot portion 110. There is only moderate stress on the material of the key during such inward bowing of the beams, because of the fact that the abutting locations 80, 80*a*, can pivot relative to each other, as opposed to being rigidly fixed to each other as are the lower ends of the legs. It is noted that the barbs 66, 64 lie much closer to the lower end of the beams (at the merged location 76) than to the upper ends at the abutting locations, which has the advantage of providing considerable resistance to deflecting the barbs toward each other so they are anchored securely in the circuit board hole. It is noted that during installation on the circuit board, tools are applied to the upper surface 112 of the connector ends and the top surfaces 114** of the keys to press down the keys into the circuit board holes.

Applicant has constructed connectors of the type illustrated in FIGS. 1–5 and found them to operate well.

Each key had an overall height A (FIG. 4) of 0.187 inch (4.75 millimeters). The height A also can be expressed as 187 mils (one mil equals one thousandth inch). In the initial configuration shown in FIG. 4, the separation B of the outside 101, 101*a* of the legs between the upper and lower shoulders 100, 104 was 43 mils (1.09 mm) ±2 mils (±0.05 mm), the distance C between the lower projections 94, 94*a* was 58 mils (1.47 mm) ±2 mils, the distance D between the upper barbs 66, 66*a* was 55 mils (1.41 mm) ±2 mils, and the distance E between the lower barbs 64, 64*a* was 54 mils (1.38 mm) ±2 mils. The width of the initial control gap A was 10 mils (0.25 mm) ±1 mil (0.03 mm). As indicated in FIG. 5, the inside diameter F of the circuit board hole was 47 mils (1.19 mm) +2 mils (+0.05 mm) or −3 mils (−0.08 mm). The key was formed of plated phosphor bronze sheet metal having a thickness of 8 mils (0.2 mm), and the slot in the connector housing which receives the key had a width of about 10 mils (0.25 mm). It should be noted that in the present descriptions, terms such as "upper", "lower", "vertical", etc. have been used to aid in the description of the invention, but it should be understood that the parts can be used in any orientation with respect to gravity.

FIG. 6 shows another key 120 which can be installed in the housing slot of FIG. 5. The key 120 has a pair of arms 122, 122*a* with lower end portions 124, 124*a* designed to project through a circuit board hole and to hold a pair of barbs 130, 132 in the circuit board hole. However, the lower end portions 124, 124*a* are unconnected so they are free to deflect toward and away from each other. Opposite upper end portions 134, 134*a* of the arms are rigidly connected together, with the upper end portions being designed to lie in the slot of the connector housing. When the key is pushed down into the hole of a circuit board indicated at 136, a pair of abutting locations 140, 140*a* are deflected together, so that further movement of the barbs such as 130*a* towards each other results in inward bowing of the beams towards each other. The abutment of the abutting locations 140, 140*a* results in moderately high resistance of the beams and barbs thereon to deflection towards each other, and yet stresses in the lower end portions 124, 124*a* of the beams is minimized because the beams are not rigidly connected to each other but can pivot relative to each other about the abutting locations 140, 140*a*.

Thus, the invention provides an electrical connector with keys that project into holes of a circuit board when the connector is mounted on the board. Each key has a pair of largely vertically extending arms that are deflected closer together when the lower portion of the key is projected into the circuit board hole. Applicant constructs the key so that first adjacent ends of the legs are rigidly joined together by merging into each other, while the opposite second end portions of the legs are free to move towards and away from each other but have abutting locations that abut each other when the arms are installed fully into the circuit board hole. The key lies in a narrow slot in the connector housing, and the slot can have a narrow portion which holds part of the middle of the key. The key has upper and lower shoulders that abut corresponding surfaces in the slot to prevent upward or downward movement of the key relative to the connector housing. The merged ends of the legs are preferably at the lower ends of the legs which project into the circuit board hole, so the merged lower ends can form a fully tapered nose to accurately enter into the circuit board hole.

I claim:

1. An electrical connector designed to mount on a circuit board that has a pair of key-receiving holes, where the connector includes a connector housing having a pair of horizontally spaced ends and having a vertical slot in each end, and a pair of keys that each lies in one of said slots and has a lower key part projecting below said housing to enter one of said board holes, where each key has a pair of largely vertically-extending legs, characterized by:

each of said key legs has upper and lower ends portions and a middle, with a first of said leg end portions of each leg joined together and with the opposite second of said leg end portions of each leg being free of each other but having protuberances that extend towards each other and that abut each other when said legs are deflected toward each other, with said protuberances being close enough that said key is substantially free of plastic deformation when said protuberances are moved close enough to abut each other.

2. The connector described in claim 1 wherein: said circuit board has upper and lower surfaces and has a plurality of contact pads on said upper surface, and said connector includes a plurality of contacts with tails that engage said contact pads when said keys project fully into said board holes;

said legs each have barbs near their lower ends that lie in said board holes when said keys project fully into said board holes;

each of said board holes is small enough to deflect said legs together close enough for said protuberances of each of said keys to abut each other when said keys project into said board holes.

3. The assembly described in claim 1 wherein: said connector housing has upper and lower key-support surfaces at a first of said slots;

said legs of a first of said keys each have a generally downwardly-facing upper shoulder and a generally upward facing lower shoulder lying adjacent respectively to said upper and lower key-support surfaces, with said lower shoulder being horizontally narrow enough to enable it to pass down through said slot during installation of said first key in said first slot, without substantial plastic deformation of any part of said key.

4. The electrical connector described in claim 1 wherein:

said lower ends of said legs are joined together and form said first leg end portions;

said lower end portion of each leg of a said key has at least one barb that projects away from the other leg and that lies below the connector housing, with each of said barbs lying closer to said lower leg ends where said legs merge than to said upper leg ends oat said protuberances that can abut each other.

5. The electrical connector described in claim 1, wherein;

said keys each have an initial orientation, when not mounted in said housing, wherein said arms are unflexed and said protuberances which can abut are widely spaced;

when each of said keys lies in one of said slots, but its lower end does not lie in a circuit board hole, said legs are bent closer together than in said initial orientation with said protuberances lying closer together than in said initial orientation but with said protuberances still being spaced apart.

6. Apparatus for holding a connector housing to a circuit board, comprising:

a key formed of a sheet of metal and having first and second largely parallel legs, said legs having lower end portions which are joined at a joined location and upper end portions which are unjoined, said lower end portions forming a tapered nose for entering a hole and also forming barbs for locking in the hole with said barbs lying above the joined location, and said upper end portions each have protuberances extending toward each other to abut each other when said legs are pressed toward each other, said protuberances positioned close enough and said legs being long enough, that said key undergoes only elastic deformation when said protuberances abut each other.

7. The apparatus described in claim 6 wherein: said protuberance are constructed to enable said leg upper end portions to pivot on one another when sid protuberances abut each other, with at least one of said protuberances being convex.

8. The apparatus described in claim 6 including: a connector housing having a key-receiving vertical slot with a narrow portion and with upper and lower key support surfaces respectively at the top and bottom of said slot narrow portion, said key extending through said slot;

each leg of said key has a middle lying between said upper and lower end portions, and the upper end portion and middle of each leg each have a largely horizontally-extending projection lying respectively immediately above and immediately below said upper and lower key support surfaces;

said lower projections extending horizontally by a small enough amount that said lower projections can pass downwardly through said slot without substantial plastic deformation of said key, and said narrow slot portion is narrow enough that said legs are flexed to bring said abutments closer together when said key lies in said slot.

9. The apparatus described in claim 8 including:

a circuit board which includes upper and lower board surfaces and a largely circular hole extending between said board surfaces, said connector housing lying on said upper surface and said lower ends of said legs project through said board hole, with said protuberances abutting each other.

10. A connector and circuit board assembly comprising:

a circuit board which has a plurality of key-receiving holes;

a connector which has a housing and a plurality of keys mounted in the housing for insertion into said board holes; a first of said keys has a pair of largely parallel legs extending into a first of said board holes with each leg having hole-engaging parts pressing against walls of the hole, each of said legs having first and second ends, with said second ends rigidly joined together to resist relative pivoting and said first ends being free to move toward and away from each other;

said first ends of said legs have abutments, with at least one of said abutments being a protuberance that extends toward the other abutment, with said abutments engaging each other when said legs are pressed toward each other, thus allowing said legs to deflect only elastically, and said first hole is small enough to deflect said legs together close enough for said abutments to abut each other when said first key lies in said first hole.

* * * * *